US012065931B2

(12) United States Patent
Luo et al.

(10) Patent No.: US 12,065,931 B2
(45) Date of Patent: Aug. 20, 2024

(54) DEVICE AND METHOD FOR ACCURATELY FIXING INTERNAL WATERSTOP IN LAKEBED TUNNEL

(71) Applicant: CHINA MCC5 GROUP CORP. LTD., Sichuan (CN)

(72) Inventors: Li Luo, Sichuan (CN); Jiang Li, Sichuan (CN)

(73) Assignee: CHINA MCC5 GROUP CORP. LTD., Sichuan (CN)

( * ) Notice: Subject to any disclaimer, the term of this patent is extended or adjusted under 35 U.S.C. 154(b) by 222 days.

(21) Appl. No.: 17/585,202

(22) Filed: Jan. 26, 2022

(65) Prior Publication Data

US 2022/0235659 A1 Jul. 28, 2022

(30) Foreign Application Priority Data

Jan. 26, 2021 (CN) ..... 202110104549.5

(51) Int. Cl.
*E21D 11/38* (2006.01)

(52) U.S. Cl.
CPC ..... *E21D 11/381* (2013.01); *E21D 11/385* (2013.01)

(58) Field of Classification Search
CPC ..... E21D 11/381; E21D 11/385; E04B 1/6806; E04B 1/6807; E04B 1/68; E04B 1/948; E02D 29/16; E02D 31/02; E02B 3/16; E01D 19/06; E01D 19/065; E01D 19/067
See application file for complete search history.

(56) References Cited

FOREIGN PATENT DOCUMENTS

| | | | | |
|---|---|---|---|---|
| DE | 10136819 A1 * | 2/2003 | ..... | E04B 1/6806 |
| DE | 102006053184 A1 * | 4/2008 | ..... | E04B 1/161 |
| DE | 102016217430 A1 * | 3/2018 | ..... | E04B 1/6806 |
| EP | 0568799 A1 * | 11/1993 | | |
| KR | 101000820 B1 * | 12/2010 | | |
| KR | 101131869 B1 * | 4/2012 | | |
| KR | 101549418 B1 * | 9/2015 | | |
| WO | WO-2020125827 A1 * | 6/2020 | ..... | E02B 3/16 |

* cited by examiner

*Primary Examiner* — Theodore V Adamos
(74) *Attorney, Agent, or Firm* — NKL Law; Allen Xue

(57) ABSTRACT

The invention discloses a device and a method for accurately fixing an internal waterstop in a lakebed tunnel, comprising two supporting bars arranged in parallel, two transverse clamping bars arranged in parallel between the supporting bars, vertical clamping bars arranged on the transverse clamping bars, wherein the supporting bars, the transverse clamping bars and the vertical clamping bars are mutually perpendicular, at least two vertical clamping bars are arranged on each transverse clamping bar, and the vertical clamping bars are arranged at the inner side of the transverse clamping bars. The beneficial effects of the invention are as follows: With vertical clamping bars that clamp the waterstop, the invention can limit the movement and rotational degree of freedom of the waterstop within in the space, to avoid displacement of the waterstop, thus making the construction more productive.

8 Claims, 1 Drawing Sheet

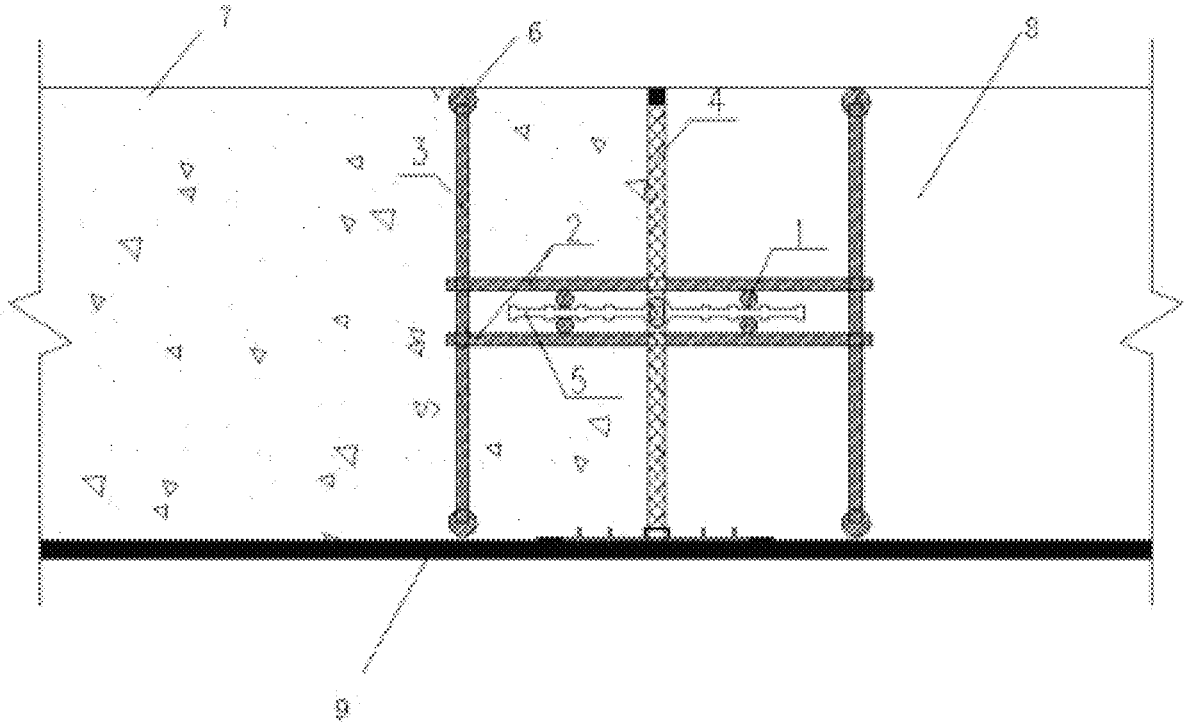
7
6
8
4
3
2
1
5
9

DEVICE AND METHOD FOR ACCURATELY FIXING INTERNAL WATERSTOP IN LAKEBED TUNNEL

TECHNICAL FIELD

The invention relates to the technical field of tunnel construction, more specifically, a device and a method for accurately fixing an internal waterstop in a lakebed tunnel.

BACKGROUND

Lakebed tunnels typically grapple with large design span, complicated mechanical characteristics of structures, many construction processes, limited construction period, and high water pressure. For this reason, the waterproofing construction quality is highly demanding. Lakebed tunnels generally need triple waterproofing, namely, self-waterproofing of tunnel concrete structures, waterproofing at deformation joint and external waterproofing. Due to the high water pressure, any substandard process in construction may result in leakage of lakebed tunnel, leading to new ecological and environmental issues.

Affected by the burial depth, tunnels usually have dense bars, leaving the installation of waterstops extremely tricky. In this regard, water leak arising from the displacement and damage of internal rubber waterstops occurs frequently. To accurately fix the internal rubber waterstops and avoid the damage thereof during installation has become a priority in researches.

Currently, internal waterstops used in tunnels are mainly fixed with bar clamp, which has the following disadvantages: (1) Waterstops can hardly be fixed completely with bar clamps. The displacement of the internal waterstops is uncertain, which can be simplified as the displacement in X, Y, and Z directions. Therefore, the waterstops can be effectively fixed only when it is fully locked in the three directions; With bar clamps, however, the waterstops can only be fixed in two directions in most cases. Blamed on the machining accuracy, only a single direction can be fixed sometimes. (2) The waterstops may be damaged when bar clamps are welded and fixed. In general, the sizes of bar clamps should match that of the waterstops as much as possible, to ensure that bar clamps can be properly fixed. However, as the bar clamps usually have a small diameter (less than φ10), they are easy to damage the waterstop when being fixed and welded. (3) When used for a steel bar with a small diameter, the bar clamp can be processed relatively easily, yet the fixing effect is not desirable. As for a steel bar with a greater diameter, the fixing effect will be improved, yet the processing quality of the bar clamp is unwarrantable.

SUMMARY OF THE INVENTION

To overcome the disadvantages of the prior art, the invention provides a device and a method for accurately fixing an internal waterstop in a lakebed tunnel, which can make the waterstop located and installed in a more accurate way, thus avoiding displacement of the waterstop and ensuring the construction quality.

The invention is achieved by the following technical solution: a device for accurately fixing an internal waterstop in a lakebed tunnel, comprising two supporting bars arranged in parallel, two transverse clamping bars arranged in parallel between the supporting bars, vertical clamping bars arranged on the transverse clamping bars, wherein the supporting bars, the transverse clamping bars and the vertical clamping bars are mutually perpendicular, at least two vertical clamping bars are arranged on each transverse clamping bar, and the vertical clamping bars are arranged at the inner side of the transverse clamping bars.

Furthermore, to better realize the invention, the spacing between the supporting bars is greater than the width of the waterstop.

Furthermore, to better realize the invention, the vertical clamping bars on one transverse clamping bar are aligned one-to-one with the vertical clamping bars on the other transverse clamping bar.

Furthermore, to better realize the invention, the spacing between the vertical clamping bars corresponding to different transverse clamping bars is less than or equal to the minimum thickness of the waterstop.

Furthermore, to better realize the invention, the transverse clamping bars are slidably arranged on the supporting bars.

Furthermore, to better realize the invention, the vertical clamping bars are slidably arranged on the transverse clamping bars.

Furthermore, to better realize the invention, a diagonal brace is provided between the transverse clamping bars and the supporting bars.

A method for accurately fixing an internal waterstop in a lakebed tunnel, comprising the following steps:

Step 1: constructing the bar construction in the tunnel;

Step 2: temporarily fixing the waterstop at the design position;

Step 3: constructing the supporting bars, the vertical clamping bars and the transverse clamping bars, and clamping the ends of the waterstop with the vertical clamping bars;

Step 4: welding the supporting bars and the transverse clamping bars;

Step 5: constructing the supporting bars at locations other than the ends of the waterstop.

Furthermore, to better realize the invention, the supporting bars are welded with the bar construction of the tunnel.

The beneficial effects of the invention are as follows: With vertical clamping bars that clamp the waterstop, the invention can limit the movement and rotational degree of freedom of the waterstop within in the space, to avoid displacement of the waterstop, thus making the construction more productive.

BRIEF DESCRIPTION OF THE DRAWINGS

The FIGURE is the schematic diagram for the installation of the fixing device, wherein, 1—vertical clamping bar, 2—transverse clamping bar, 3—supporting bar, 4—joint filler, 5—waterstop, 6—main bar, 7—pre-cast concrete, 8—post-cast concrete, 9—upstream face of structure.

DETAILED DESCRIPTION OF THE PREFERRED EMBODIMENTS

The present invention will be further described in detail in combination with examples, but it is not limited to the following embodiments.

Embodiment 1

As shown in the FIGURE, in the embodiment, a device for accurately fixing an internal waterstop in a lakebed tunnel, comprising two supporting bars arranged in parallel 3, two transverse clamping bars 2 arranged in parallel between the supporting bar 3 and the supporting bar 3, vertical clamping bars 1 arranged on the transverse clamping bars 2, wherein the supporting bars 3, the transverse clamping bars 2 and the vertical clamping bars 1 are mutually perpendicular, at least two vertical clamping bars 1 are arranged on each transverse clamping bar 2, and the vertical clamping bars 1 are arranged at the inner side of the transverse clamping bars 2.

In construction, structural steel bars of the tunnel are first constructed, the supporting bars 3 are welded to the main bars 6 of the structural steel bars, and both ends of the waterstop 5 are temporarily fixed and installed at the corresponding positions, wherein the median line of the waterstop 5 falls at the design joint between the two tunnels. The transverse clamping bars 2 and the vertical clamping bars 1 are constructed respectively, the transverse clamping bars 2 are welded on the supporting bars 3, the waterstop 5 is subject to pressure exerted by the vertical clamping bars 1 on both sides of the waterstop 5, then supporting bars in the middle of the waterstop 5 are constructed, and finally the waterstop 5 is accurately fixed.

By exerting clamping force at the ends of the waterstop 5 with the vertical clamping bars 1, the invention makes the vertical clamping bars 1 in close contact with the waterstop 5, effectively limiting the ends of the waterstop 5 in all directions, thus limiting the ends of the waterstop 5 to the required position and ensuring its positional accuracy. In this way, the waterstop 5 can be positioned more accurately when the middle of the waterstop 5 is fixed later. This improves the shock resistance at the ends of the waterstop 5 during concreting, avoiding the displacement of the waterstop 5 caused by impact of concrete, thereby ensuring the construction quality.

Free of clamp structures, the invention stands out for easy, convenient operations, which makes the construction faster, more productive and less difficult. As the vertical clamping bars 1 are in contact with the waterstop 5 via a cylindrical surface, the pressure exerted on the waterstop 5 is distributed evenly, thus better avoiding water leak caused by the waterstop 5 being crushed by the vertical clamping bars 1.

In this embodiment, the vertical clamping bars 1 and the transverse clamping bars 2 can be welded, to improve the connection strength and relative position accuracy of the vertical clamping bars 1 and the transverse clamping bars 2. This aims to avoid the displacement of the waterstop 5 caused by relative displacement between the vertical clamping bars 1 and the transverse clamping bars 2 amidst impact of concrete.

Embodiment 2

On the basis of the above embodiment, in this embodiment, the spacing between the supporting bar 3 and the supporting bar 3 is greater than the width of the waterstop 5. In this way, the waterstop 5 can be shunned when welding the supporting bars 3 and the transverse clamping bars 2, thereby preventing the waterstop 5 from being damaged during welding.

Embodiment 3

Based on the above embodiment, in this embodiment, the vertical clamping bars 1 on one transverse clamping bar 2 are aligned one-to-one with the vertical clamping bars 1 on the other transverse clamping bar 2. When the vertical clamping bar 1 clamps the waterstop 5, the pressure on both sides of the waterstop 5 can be distributed symmetrically. This prevents the waterstop 5 from being subject to ending deformation under the pressure, thereby helping the waterstop 5 better maintain the positional accuracy.

In the embodiment, the spacing between the vertical clamping bars 1 corresponding to different transverse clamping bars 2 is less than or equal to the minimum thickness of the waterstop. In this way, the vertical clamping bars 1 can fully clamp the waterstop 5, thereby preventing the waterstop 5 from loosening.

Embodiment 4

On the basis of the above embodiment, in this embodiment, the transverse clamping bars 2 are slidably arranged on the supporting bars 3, so that the spacing between the transverse clamping bar 2 and the transverse clamping bar 2 can be adjusted by the relative sliding of the transverse clamping bars 2 and the supporting bars 3. In this way, the spacing between the vertical clamping bars 1 on different transverse clamping bars 2 can be adjusted, thus making the clamping force exerted by the vertical clamping bars 1 on the waterstop 5 adjustable.

In this embodiment, one of the supporting bars 3 can be provided with two sections of external threads that are symmetrically distributed and in opposite rotation direction, and the two transverse clamping bars 2 are respectively provided with internal thread sleeves correspondingly connected to the external threads. The transverse clamping bars 2 are provided, at the other end, with a sleeve connected to the other supporting bar 3. When the waterstop 5 is clamped, the two transverse clamping bars 2 can be controlled to move toward or away from each other by rotating the supporting bars 3 with external threads. This helps better adjust the spacing between the two transverse clamping bars in a manual way as well as the clamping force exerted by the vertical clamping bars 1 on the waterstop 5 based on construction conditions.

In this embodiment, the vertical clamping bars 1 are slidably arranged on the transverse clamping bars 2. This helps better adjust the spacing between the vertical clamping bars 1 on the same transverse clamping bar 2 according to the specific construction conditions, and the size or model of the waterstop 5.

In this embodiment, the transverse clamping bars 2 are rotationally connected to the internal thread sleeve and the sleeve respectively. Besides, the transverse clamping bars 2 can also be provided with two sections of external threads that are symmetrically distributed and in opposite rotation direction. The vertical clamping bars 1 are provided with external thread sleeves connected to the external thread, so that the two vertical clamping bars 1 can be controlled to move toward or away from each other by rotating the transverse clamping bars 2. In this way, the spacing between the two vertical clamping bars can be adjusted.

A diagonal brace is provided between the transverse clamping bars 2 and the supporting bars 3.

The other steps in the present embodiment are identical to those in the above-mentioned embodiments and will not be repeated herein.

The above-mentioned embodiments are only preferred embodiments of the present invention and are not restricted thereto in any way. Any simple modification and equivalent alterations made to these embodiments based on the technical essence of the present invention fall within the protection scope of the present disclosure.

The invention claimed is:

1. A device for affixing a waterstop in a lakebed tunnel, comprising: a first supporting bar and a second supporting bar arranged in parallel in a first direction, a first transverse clamping bar and a second transverse clamping bar arranged in parallel in a second direction between the first supporting bar and the second support bar, and a first group of and a second group of vertical clamping bars arranged in parallel in a third direction, wherein the first group of vertical clamping bars are affixed to the first transverse clamping bar, and the second group of vertical clamping bars are affixed to the second transverse clamping bar, and a space between the first group and the second group of vertical clamping bars is configured to receive the waterstop, wherein the first group and second group of vertical clamping bars are configured to directly contact the waterstop such that the length of the waterstop extends in the third direction and the width of the waterstop extends in the second direction, wherein the first direction, the second direction, and the third direction are orthogonal relative to one another, and wherein each of the first supporting bar, the second supporting bar, the first transverse clamping bar, and the second transverse clamping bar is straight and linear in shape.

2. The device according to claim 1, wherein a spacing between the first supporting bar and the second supporting bar is greater than the width of the waterstop.

3. The device according to claim 1, wherein each of the first group of vertical clamping bars is aligned with one of the second group of vertical clamping bars.

4. The device according to claim 3, wherein the spacing between the first group and the second group of vertical clamping bars is less than or equal to a minimum thickness of the waterstop.

5. The device according to claim 1, wherein the first and the second transverse clamping bars are slidable in the first direction along the first and the second supporting bars.

6. The device according to claim 1, wherein each of the plurality of vertical clamping bars are slidable in the second direction along the first or the second transverse clamping bars.

7. A method for affixing an internal waterstop in a lakebed tunnel, comprising:

Step 1: constructing the lakebed tunnel;

Step 2: temporarily affixing the waterstop at a predetermined position;

Step 3: constructing the device of claim 1, wherein the waterstop is placed in the space between the first group and the second group of vertical clamping bars; and Step 4: welding the first and the second transverse clamping bars to the first and the second supporting bar.

8. The method according to claim 7, wherein the first and the second supporting bars are welded to reinforcement bars in the tunnel.

* * * * *